US007137779B2

(12) United States Patent
Liang

(10) Patent No.: US 7,137,779 B2
(45) Date of Patent: Nov. 21, 2006

(54) GAS TURBINE AIRFOIL LEADING EDGE COOLING

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 197 days.

(21) Appl. No.: 10/854,916

(22) Filed: May 27, 2004

(65) Prior Publication Data

US 2005/0265835 A1 Dec. 1, 2005

(51) Int. Cl.
*F01D 5/08* (2006.01)
*F01D 5/18* (2006.01)

(52) U.S. Cl. ..... 416/1; 416/97 R

(58) Field of Classification Search ..... 416/1, 416/97 R, 115
See application file for complete search history.

(56) References Cited

U.S. PATENT DOCUMENTS 4,573,865 A * 3/1986 Hsia et al. ..... 415/115
5,259,730 A 11/1993 Damlis et al.
5,271,715 A 12/1993 Zelesky et al.
5,387,085 A 2/1995 Thomas, Jr. et al.
5,660,524 A 8/1997 Lee et al.
5,813,836 A 9/1998 Starkweather
5,967,752 A * 10/1999 Lee et al. ..... 416/97 R
5,975,851 A 11/1999 Liang
6,036,441 A 3/2000 Manning et al.
6,126,396 A 10/2000 Doughty et al.
6,139,269 A 10/2000 Liang
6,174,134 B1 1/2001 Lee et al.
6,206,638 B1 3/2001 Glynn et al.
6,220,817 B1 4/2001 Durgin et al.
6,290,463 B1 9/2001 Fargher et al.
6,431,832 B1 8/2002 Glezer et al.
6,435,813 B1 8/2002 Rieck, Jr. et al.
6,491,496 B1 12/2002 Starkweather
6,572,329 B1 6/2003 Tiemann
6,602,052 B1 8/2003 Liang
6,607,355 B1 8/2003 Cunha et al.
6,960,060 B1 * 11/2005 Lee ..... 415/115
2002/0018717 A1 2/2002 Dailey

* cited by examiner

*Primary Examiner*—Edward K. Look
*Assistant Examiner*—Devin Hanan

(57) ABSTRACT

A gas turbine airfoil (34) includes sequentially connected, radially displaced chambers (e.g., 46, 58) within the airfoil. A cooling fluid supply chamber (46) is disposed within a first section (48) of a leading edge portion (36) of the airfoil and receives a cooling fluid flow (50). The cooling fluid supply chamber is in fluid communication with a first leading edge impingement chamber (52) disposed against a backside (44) of the leading edge portion. A discharge chamber (58) in serial fluid communication with the first impingement chamber is disposed radially outward of the first impingement chamber and within a second section (60) of the leading edge portion. A second leading edge impingement chamber (62) in fluid communication with the discharge chamber is disposed against a backside (64) of the leading edge portion in the second section. The chambers may be arranged to limit centrifugal force-induced pressure buildup in the respective chambers.

9 Claims, 4 Drawing Sheets

GAS TURBINE AIRFOIL LEADING EDGE COOLING

FIELD OF THE INVENTION

This invention relates generally to gas turbines engines, and, in particular, to cooling of gas turbine airfoils.

BACKGROUND OF THE INVENTION

Gas turbine airfoils exposed to hot combustion gases have been cooled by forming passageways within the airfoil and passing a cooling fluid through the passageways to convectively cool the airfoil. The cooling fluid may include compressed air bled from a compressor of the gas turbine. Such cooled airfoils may include a serpentine, multiple-pass flow path to provide sufficient convective cooling to maintain all portions of the airfoil at a relatively uniform temperature. While such cooling configurations may be effective for cooling airfoils, diverting any portion of air from the compressor to provide a cooling fluid flow decreases the overall efficiency of the gas turbine. Accordingly, it is desired to minimize the amount of compressed air bled from the compressor while attempting to achieve sufficient cooling of airfoils in a gas turbine.

A variety of cooling schemes for have been proposed for cooling certain portions of an airfoil, such as a leading edge portion of the airfoil. FIG. 1 illustrates a known arrangement for cooling a leading edge of an airfoil 10. FIG. 1 is a cross sectional view of an airfoil 10 having a leading edge portion 12 cooled with a first up-pass of a cooling fluid flow 14 within a leading edge cooling channel 16. One problem with such as design is that a distribution and velocity of the cooling fluid flow 14 to a leading edge backside portion 18 of the airfoil is decreased compared to the distribution and velocity in a central portion 19 of the cooling channel 16. As a result, heat transfer from the backside portion 18 to the cooling fluid flow 14 may be decreased compared to heat transfer to the cooling fluid flow 14 in the central portion 19. Increased cooling flow may alleviate this problem, but at the cost of reduced efficiency.

FIG. 2 illustrates another known arrangement for cooling a leading edge of an airfoil 20 using backside impingement cooling. FIG. 2 is a cross sectional view of an airfoil 20 having a leading edge portion 22 cooled by impingement against a backside 26 of the leading edge of a cooling fluid flow 24. A cooling fluid flow 24 may be directed through impingement holes 28 from a leading edge cooling channel 30 into an impingement chamber 31. While this arrangement may allow better control of the cooling flows for cooling the leading edge portion 22 (especially with comparatively lower cooling flows volumes) cooling of a radially outward portion of the airfoil 20 may be compromised. For example, it may be desired to achieve a constant pressure differential between the leading edge cooling channel 30 and the impingement chamber 31. The cooling fluid flow 24 injected into a rotating airfoil 20, however, may experience a centrifugally-induced pressure rise in a radially outward direction 33. For example, the cooling fluid flow 24 flowing in the cooling channel 30 may increase from a pressure of 100 pounds per square inch (psi) near the root 23 of the airfoil to a pressure of 130 psi near the tip 21. As a result, a geometry of the impingement holes 28 may need to be modified, such as by spacing the holes 28 increasingly further apart in a radially outward direction 33, to maintain a desired pressure differential along the leading edge portion between the leading edge cooling channel 30 and the impingement chamber 31. However, by spacing the impingement holes further apart, respective jets 32 of the cooling fluid flow passing through each of the impingement holes 28 may be spaced too far apart to cover an entire backside 26 of the leading edge portion 22. Consequently, wider spacing of the impingement holes 28 may result in local hot spots on the leading edge portion 22 between areas where the spaced jets 32 impinge, thereby causing uneven cooling of the leading edge portion 22.

BRIEF DESCRIPTION OF THE DRAWINGS

The invention will be more apparent from the following description in view of the drawings that show.

DETAILED DESCRIPTION OF THE INVENTION

Figure 1:
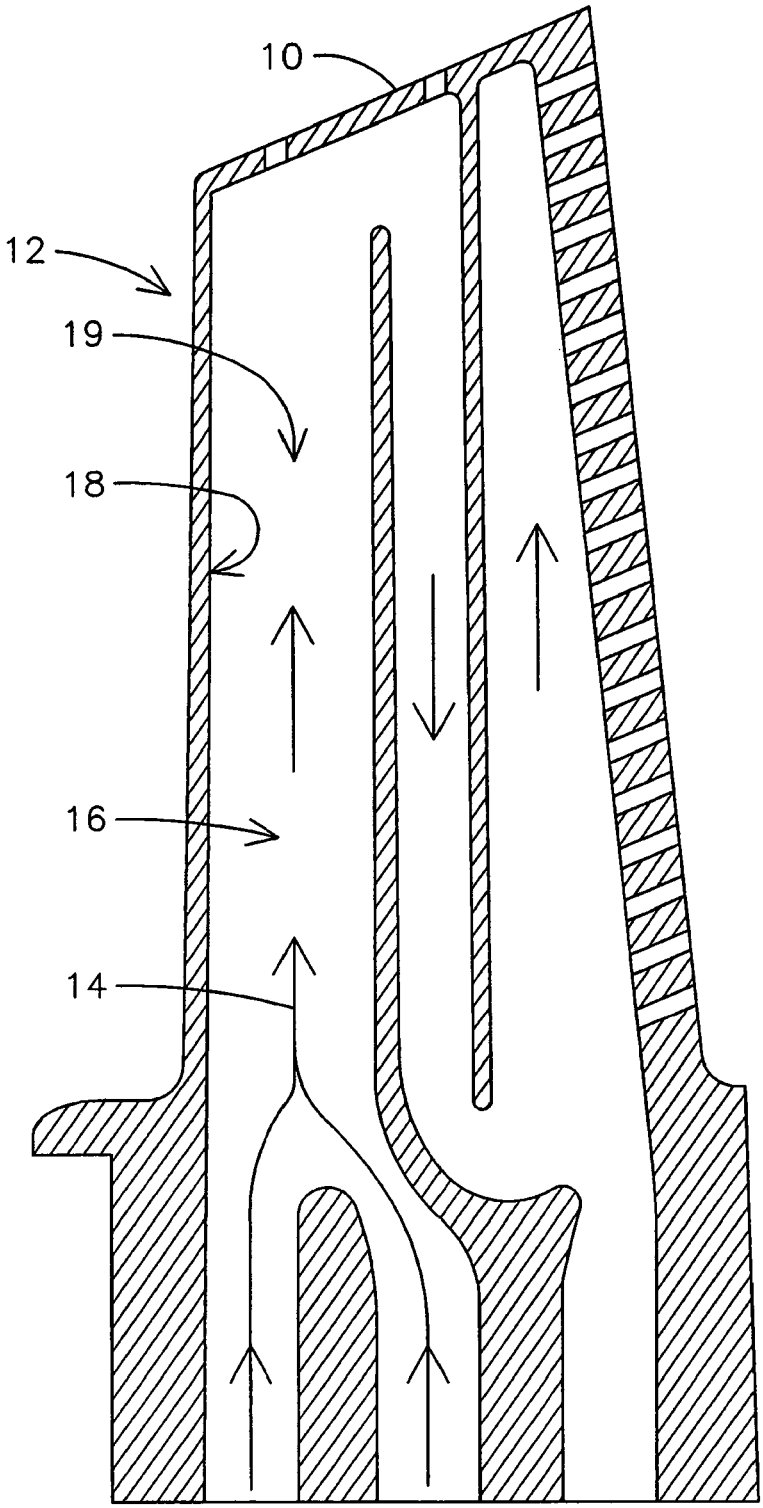
FIG. 1 PRIOR ART
FIG. 1 is a cross sectional view of a gas turbine airfoil having leading edge convection cooling as known in the art.
Figure 2:
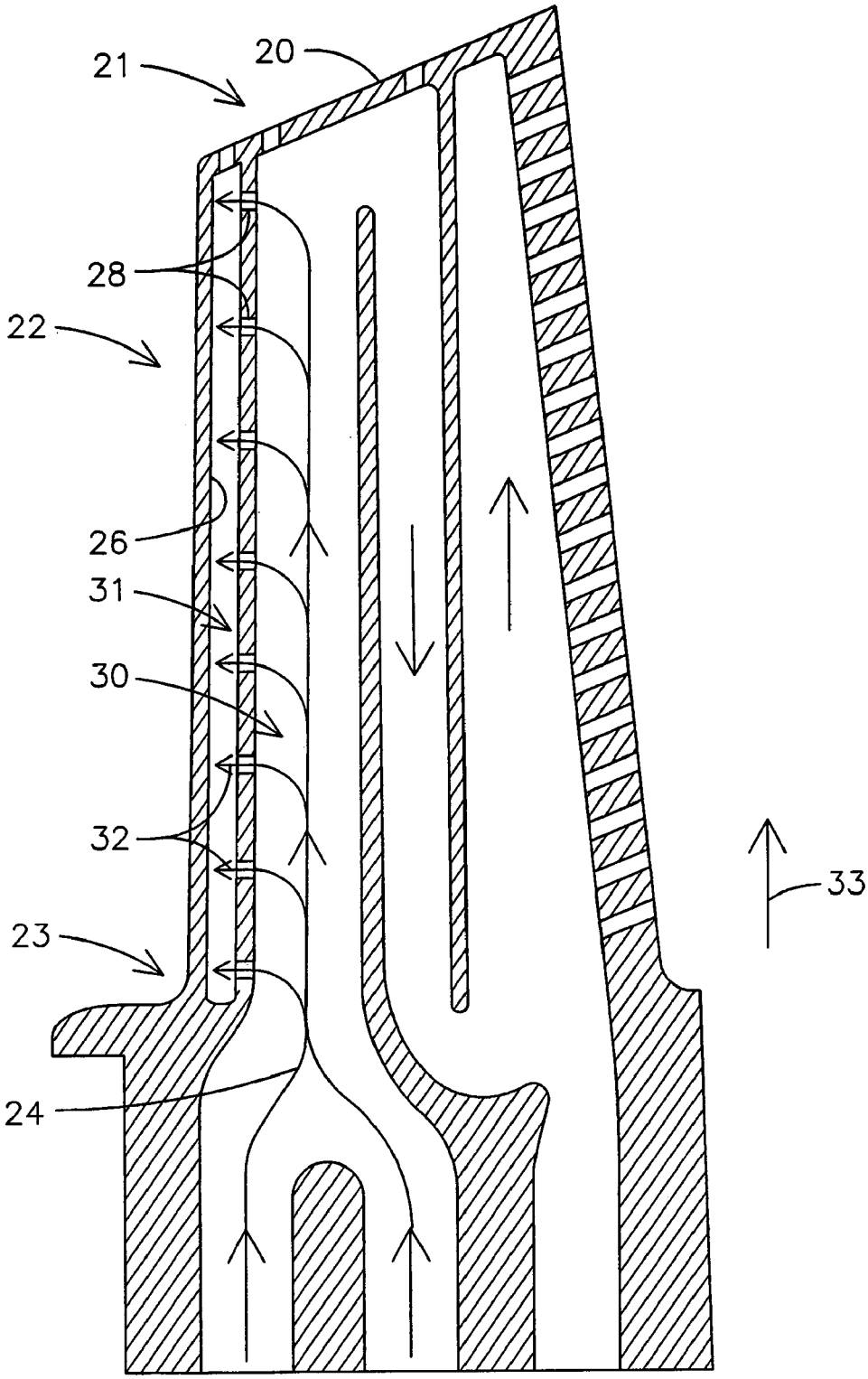
FIG. 2 PRIOR ART
FIG. 2 is a cross sectional view of a gas turbine airfoil having leading edge impingement cooling as known in the art.
Figure 3:
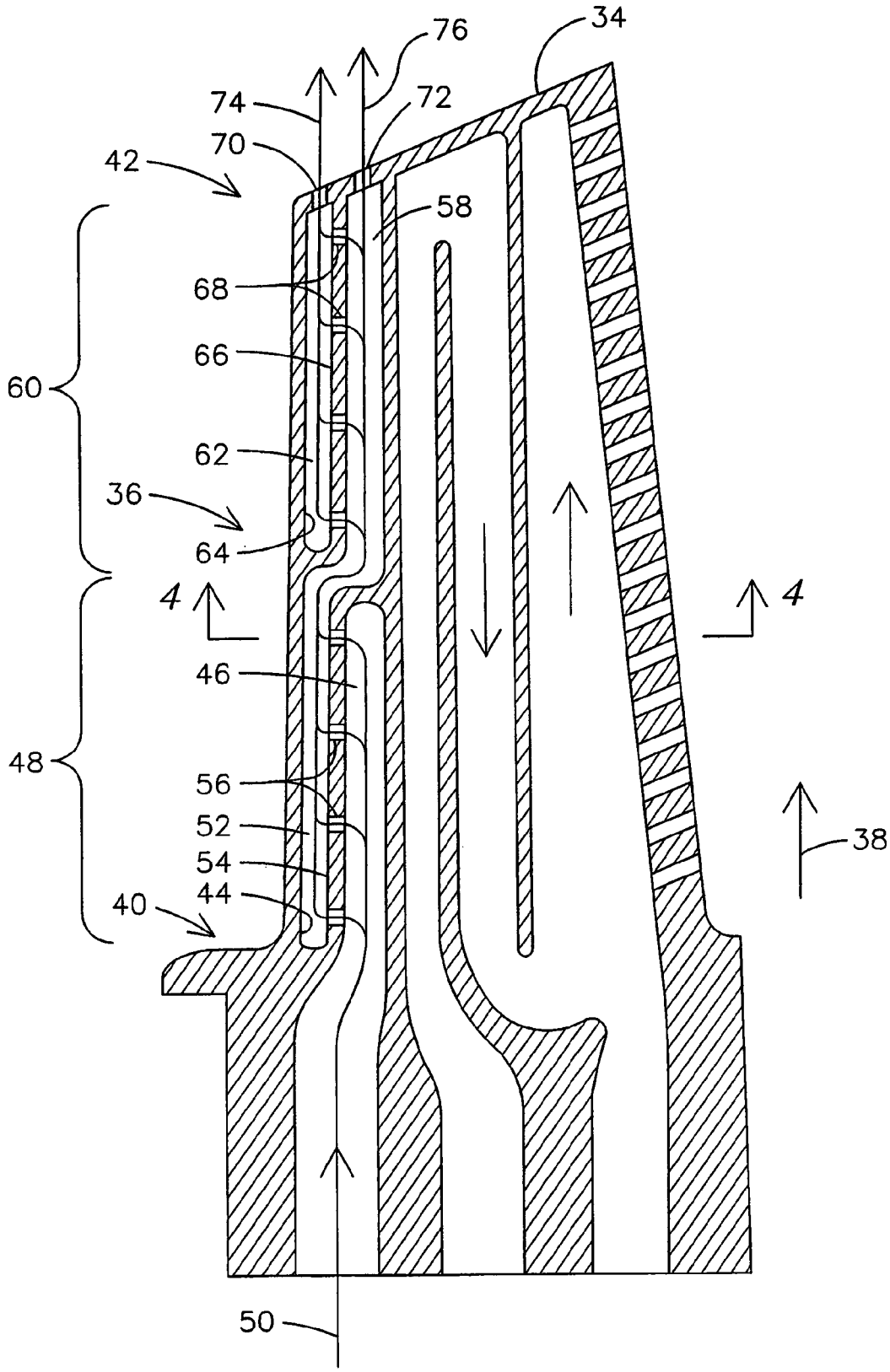
FIG. 3 is a cross sectional view of an embodiment of a gas turbine airfoil having improved leading edge cooling.
Figure 4:
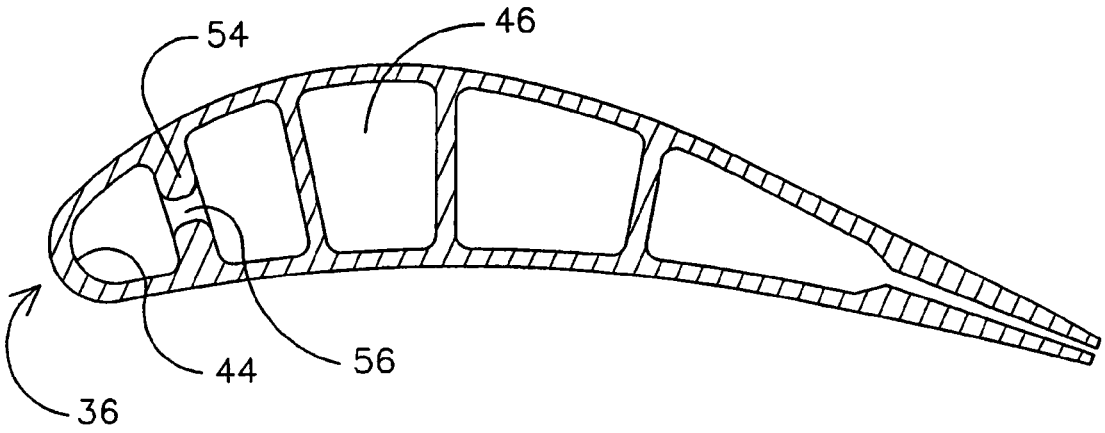
FIG. 4 is a cross sectional view of the gas turbine airfoil of FIG. 3 taken along line A—A.

The inventor of the present invention has developed an improved cooled gas turbine airfoil having an innovative leading edge cooling scheme that may be used with reduced cooling fluid flows compared to conventional techniques. FIG. 3 is a cross sectional view of an embodiment of the gas turbine airfoil 34, while FIG. 4 shows a cross sectional view of the gas turbine airfoil of FIG. 3 taken along line A—A. Generally, the airfoil 34 includes a leading edge portion 36 extending in a radial direction 38 from a root 40 to a tip 42 of the airfoil 34. Within the leading edge portion 36, a series of fluidically interconnected chambers are provided. The interconnected chambers are configured to supply a cooling fluid flow, impinge the cooling fluid flow against a backside 44 of the leading edge portion 36, and collect the cooling fluid flow after impingement.

To achieve improved leading edge cooling, a cooling fluid supply chamber 46 may be disposed within a first section 48 of the leading edge portion 36 and may extend radially away from the root 40 of the airfoil 34. The cooling fluid supply chamber 46 receives a cooling fluid flow 50, such as a flow of compressed air bled from a stage of the compressor of the gas turbine. The cooling fluid supply chamber 46 may be in fluid communication with a first leading edge impingement chamber 52 disposed against the backside 44 of the leading edge portion 36 in the first section 48 and may receive the cooling fluid flow 50 discharged from the cooling fluid supply chamber 46. In an aspect of the invention, a partition 54 is radially disposed between the cooling fluid supply chamber 46 and the first leading edge impingement chamber 52 to control a flow of the cooling fluid flow 50 into the impingement chamber 52. The partition 54 may include one or more passageways 56 therethrough for directing the cooling fluid flow 50 from the cooling fluid supply chamber 46 into the impingement chamber 52 to impinge against the backside 44 of the leading edge portion 36 in the first section 48. The passageways 56 may be sized, shaped, positioned, and spaced to provide sufficient impingement cooling of the first section 48 of the leading edge portion 36. For example, the passageways 56 may be spaced apart close enough to achieve sufficient impingement coverage of the cooling flow 50 on the backside 44 of the first section 48 for a certain volume of the cooling fluid flow 50.

After the cooling fluid 50 is impinged on the backside 44 of the first section 48, the cooling fluid flow 50 may be directed into a discharge chamber 58 in serial fluid communication with the first fluid supply chamber 46. In an aspect of the invention, the discharge chamber 58 may be disposed radially outward of the first fluid supply chamber 46 within a second section 60 of the leading edge portion 36. In this manner, the cooling fluid flow 50 may be innovatively collected for reuse to cool another leading edge section. Advantageously, the first fluid supply chamber 46 and the discharge chamber 58 may be configured and connected to take advantage of a centrifugal force acting on the cooling fluid 50 in a radially outward direction to force the cooling fluid 50 from the first fluid supply chamber 46 into the discharge chamber 58 after impinging on the backside 44.

The cooling flow 50 may be collected in the discharge chamber 58 and then directed from the discharge chamber 58 into a second leading edge impingement chamber 62 disposed against a backside 64 of the second section 60 the leading edge portion 36. A partition 66 having impingement passageways 68 may be radially disposed between the discharge chamber 58 and the second leading edge impingement chamber 52 as described above for directing the cooling fluid flow 50 from the discharge chamber 58 and the second leading edge impingement chamber 52 to impinge against the backside 64 of the leading edge portion 36 in the second section 60. The discharge chamber 58 and the second impingement chamber 52 may include respective outlet holes 70, 72 at the tip 42 of the airfoil for discharging respective portions 74, 76 of the cooling fluid. The holes 70, 72 may be sized to achieve a desired discharge pressure based on the pressure of the cooling flow inside the airfoil and a gas pressure outside the airfoil.

Using the configuration described above, the cooling fluid 50 may be innovatively reused to provide impingement cooling of the first and second sections 48, 60 of the leading edge portion 36. This technique allows localized control over cooling of the leading edge portion 36. For example, each section 48, 60 may be sized in a radial direction to tailor impingement cooling in the sections 48, 60 corresponding to an airfoil leading edge external heat load and an external radial pressure profile. By reusing the same volume of cooling air 50 in each section, the amount of cooling air necessary may be reduced compared to conventional leading edge cooling schemes that may require a comparatively larger volume of air to provide the same cooling effect.

Furthermore, by concentrating and reusing an available volume of cooling air over sequential sectional radial distances shorter than a radial length of the airfoil, a pressure increase due to centrifugal forces may be apportioned and controlled so that impingement hole geometry, such as the size, shape, and spacing of the impingement holes, may be customized to achieve improved impingement cooling. For example, by forming sequentially connected, radially displaced collection chambers to limit centrifugal force-induced pressure buildup in the respective chambers (such as by using the known method of reducing pressure via impingement discharge from each chamber) a spacing of impingement holes may be reduced compared to prior art techniques, thereby providing improved impingement cooling coverage of the backside of the leading edge.

Although an exemplary airfoil 34 having a leading edge cooling circuit for cooling two leading edge sections 48, 60 is described herein, it should be appreciated that a leading edge portion of an airfoil maybe divided into more than two cooled sections to provide improved leading edge cooling. Accordingly, an airfoil may include two or more sections having serially connected chambers so that each section includes an impingement chamber receiving a cooling fluid flow, and a collection chamber discharging a cooling fluid flow into the impingement chamber. In addition, each impingement chamber may be connected to a respective downstream collection chamber disposed radially outward of the discharging impingement chamber to discharge the cooling fluid flow into the downstream collection chamber so that a cooling fluid flow is sequentially directed from a collection chamber to an impingement chamber and then radially outward into another serially connected collection chamber to sequentially cool the leading edge portion of the airfoil.

Figure 5:
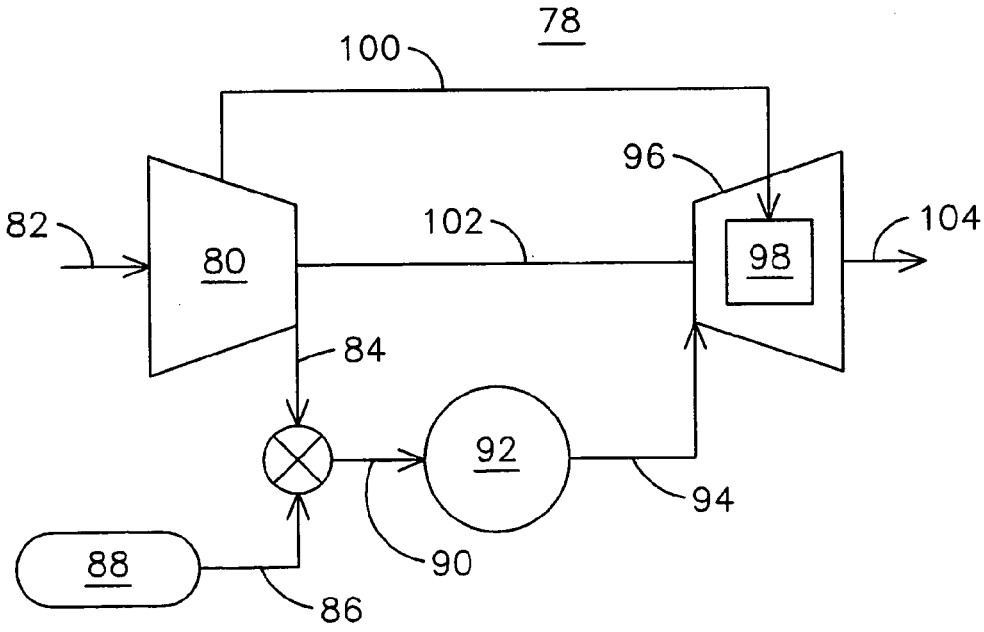
FIG. 5 is a functional diagram of a combustion turbine engine having a turbine including a cooled airfoil of the current invention.

FIG. 5 illustrates a gas turbine engine 78 including an exemplary cooled airfoil 98 as described herein. The gas turbine engine 78 may include a compressor 80 for receiving a flow of filtered ambient air 82 and for producing a flow of compressed air 84. The compressed air 84 is mixed with a flow of a combustible fuel 86, such as natural gas or fuel oil for example, provided by a fuel source 88, to create a fuel-oxidizer mixture flow 90 prior to introduction into a combustor 92. The fuel-oxidizer mixture flow 90 is combusted in the combustor 92 to create a hot combustion gas 94.

A turbine 96, including an airfoil 98, receives the hot combustion gas 94, where it is expanded to extract mechanical shaft power. In an aspect of the invention, the airfoil 98 is cooled by a flow of cooling air 100 bled from the compressor 80 using the technique of providing serially connected cooling chambers as previously described. In one embodiment, a common shaft 102 interconnects the turbine 96 with the compressor 80, as well as an electrical generator (not shown) to provide mechanical power for compressing the ambient air 82 and for producing electrical power, respectively. The expanded combustion gas 104 may be exhausted directly to the atmosphere or it may be routed through additional heat recovery systems (not shown).

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A gas turbine airfoil comprising:

a leading edge portion extending radially from a root of the airfoil to a tip of the airfoil;

a cooling fluid supply chamber disposed within a first section of the leading edge portion and extending radially away from the root, the cooling fluid supply chamber receiving a cooling fluid;

a first leading edge impingement chamber disposed against a backside of the leading edge portion in the first section and in fluid communication with the cooling fluid supply chamber, the first impingement chamber receiving the cooling fluid discharged from the cooling fluid supply chamber and discharging an impinged cooling fluid;

a discharge chamber disposed radially outward of the first leading edge impingement chamber and in serial fluid communication with the first impingement chamber within a second section of the leading edge portion, the discharge chamber receiving the impinged cooling fluid discharged from the first impingement chamber; and a second leading edge impingement chamber disposed against a backside of the leading edge portion in the second section of the leading edge portion and in fluid communication with the discharge chamber, the second impingement chamber receiving the impinged cooling fluid discharged from the discharge chamber.

2. The airfoil of claim 1, further comprising a first partition having a first passageway therethrough disposed between the cooling fluid supply chamber and the first leading edge impingement chamber.

3. The airfoil of claim 1, further comprising a second partition having a second passageway therethrough disposed between the discharge chamber and the second leading edge impingement chamber.

4. A gas turbine engine comprising the airfoil of claim 1.

5. A method of cooling a rotating gas turbine airfoil comprising:

forming sequentially connected, radially displaced collection chambers in a cooling fluid flow path along a backside of a leading edge of a gas turbine airfoil so that each chamber is in fluid communication with a respective portion of the backside of the leading edge, the chambers configured to limit centrifugal force-induced pressure buildup in the respective chambers; and supplying a cooling fluid flow from each chamber to cool the respective portion of the backside of the leading edge of the airfoil.

6. The method of claim 5, further comprising:

radially disposing a partition between the collection chamber and the respective backside of the leading edge of the airfoil; and forming an impingement hole in the partition to impinge the cooling fluid flowing from the collection chamber against the respective portion of the backside of the leading edge of the airfoil.

7. The method of claim 6, further comprising:

forming a film cooling outlet hole in the airfoil for discharging the cooling fluid flow; and selecting a geometry of the impingement hole to achieve a desired discharge pressure at the film cooling outlet hole.

8. The method of claim 5, further comprising selecting a location of the collection chamber within the airfoil so that a desired centrifugal force induced pressure increase for each collection chamber is achieved.

9. The method of claim 5, further comprising selecting a location of the collection chamber within the airfoil so that a comparatively higher pressure is achieved at a point corresponding to a portion of the surface of the airfoil having a comparatively higher cooling demand than a different portion.

* * * * *